United States Patent [19]

Matsumoto et al.

[11] 4,435,087

[45] Mar. 6, 1984

[54] MOTOR-DRIVEN MOVEMENT FOR TIMEPIECE

[75] Inventors: Akio Matsumoto, Neyagawa; Kazuhiro Araki, Hirakata, both of Japan

[73] Assignee: Matsushita Electric Works, Ltd., Osaka, Japan

[21] Appl. No.: 336,056

[22] Filed: Dec. 31, 1981

[30] Foreign Application Priority Data

Jan. 14, 1981 [JP] Japan ..... 56-6230

[51] Int. Cl.[3] ..... G04B 19/00

[52] U.S. Cl. ..... 368/76; 368/80; 368/220; 368/228; 310/40 MM

[58] Field of Search ..... 310/179, 180, 40 R, 310/40 MM, 49 R; 368/76, 77, 80, 220, 223, 228

[56] References Cited

U.S. PATENT DOCUMENTS

| | | | |
|---|---|---|---|
| 388,512 | 8/1888 | Gestel | 310/40 R |
| 3,403,272 | 9/1968 | Dold | 310/40 R |
| 3,538,703 | 11/1970 | Walton | 368/80 |
| 3,626,263 | 12/1971 | McBride | 310/49 X |
| 3,888,074 | 6/1975 | Wagenknecht et al. | 368/76 |
| 3,979,616 | 9/1976 | Stechmann | 310/49 R |
| 4,012,899 | 3/1977 | Matsuura et al. | 310/40 MM X |
| 4,141,210 | 2/1979 | Flaig | 368/203 |

*Primary Examiner*—Ulysses Weldon

*Attorney, Agent, or Firm*—King and Liles

[57] ABSTRACT

Motor-driven movement for timepieces wherein stator block core is formed in ring-shape with a magnetic material of a rounded bar, magnetic poles formed at both core ends are disposed as directed radially inward of the core and rotary shaft of minute hand wheel of output gear train meshing with a rotor disposed between the poles is radially displaced from the center of the core to the side opposite the magnetic poles, whereby internal space of the ring-shaped core having a coil wound thereon is efficiently utilized for arranging all internal components substantially within dimensions of the coil and minimizing the entire size of the movement.

4 Claims, 20 Drawing Figures

MOTOR-DRIVEN MOVEMENT FOR TIMEPIECE

This invention relates generally to motor-driven movements for timepieces and, more particularly, to improvements in the motor-driven movement for such timepieces as clocks wherein component members are compactly arranged.

For the motor-driven movements for use in such clocks as wall-hung clocks, table-clocks and the like, it has been required to make them thin and small, that is, to be small in the total volume and, thus, to have general usages so that they will be applicable not only larger clocks but also to smaller clocks, even including considerably thin wall-hung clocks. For this purpose, it has been suggested to form a stator which is a main component of electric motor in a ring shape and to dispose a rotor rotatably between opposed magnetic poles at both ends of the ring-shaped stator and output gear train cooperating with the motor within the interior space of the ring, so as to render the entire volume to be smaller.

In this arrangement, however, the rotor is arranged only between the magnetic poles which are facing each other in the peripheral direction of the ring-shaped stator without any measure for minimizing their dimensions, an output shaft of the output gear train is positioned at the center of the ring, and the space remained unused within the ring shaped stator becomes so large that the volume minimization has been inefficient.

A primary object of the present invention is, therefore, to provide a motor-driven movement for timepieces which is thin and small so as to be capable of minimizing its occupying space in the clock or the like to which the movement is applied and is high in the general uses.

A related object of the present invention is to provide a motor-driven movement for timepieces wherein the motor, circuit parts accompanying the motor and output gear train are efficiently arranged within the inner space of a ring-shaped stator to render the entire volume smaller.

A further object of the present invention is to provide a motor-driven movement for timepieces wherein magnetic poles at both ends of a ring-shaped stator are opposed to each other in a radial direction of the ring, a rotor is arranged between such magnetic poles and the output shaft of output gear train engaged with the rotor is displaced radially to the side opposite the rotor with respect to the center of the ring to thereby minimize the volume.

Another object of the present invention is to provide a motor-driven movement for timepieces wherein a bar-shaped magnetic material having circular cross-section and constant thickness is used for the stator core forming an electric motor so that, even if the volume is made small, easy assembling ability will be high, and the stator is favorably resiliently supported at the respective ends so that, even if the volume is made small, pull-out terminals of stator coil will engage with associated circuit parts under a favorable contact pressure.

A still another object of the present invention is to provide a motor-driven movement for timepieces wherein, even if the volume is made small, the stator is favorably held at the respective ends and, at the same time, the rotor positioning can be smoothly performed.

Other objects and advantages of the present invention will become apparent from the following disclosures of a preferred embodiment detailed with reference to accompanying drawings, in which.

While the present invention shall now be explained in the followings with reference to the preferred embodiment shown in the accompanying drawings, it should be understood that the present invention is not to be limited only to the particular embodiment shown but is to include all modifications, alterations and equivalent arrangement possible within the scope of appended claims.

Prior to the descriptions of the present invention, first, a well known movement disclosed in U.S. Pat. No.

Figure 1:
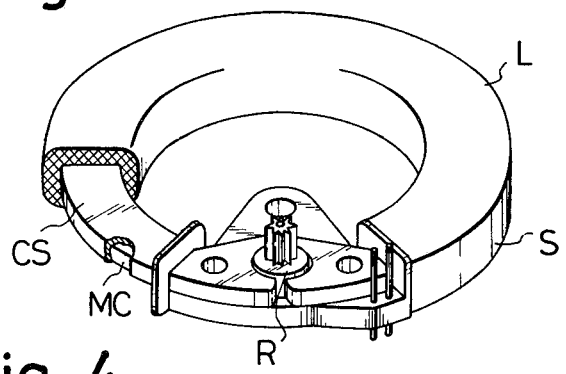
Fig. 1 (PRIOR ART)
FIG. 1 is a perspective view showing a conventional motor-driven movement for timepieces with a part removed.

4,141,210 to Flaig shall be explained with reference to FIG. 1. In this movement, a flat core MC having a certain width is formed to be ring-shaped and a coil L is wound on the core MC through a coil supporter CS to form a stator S of an electric motor. Further in this case, respective end portions of the core MC are expanded to be substantially symmetrical with each other so as to be favorable magnetic poles and are semi-circularly cut to define a substantially circular space as opposed to each other. A rotor R is disposed in the circular space so that, when an electric current is passed through the coil L, the rotor R will be magnetically driven to rotate within the circular space by means of a proper driving circuit (not shown) as has been well known and a clock gear train (not shown) will be thereby operated.

In the above described known formation, an output gear train and the like can be arranged within the ring-shaped stator so that the volume can be made small to a certain degree. However, as the flat stator core is used, the coil wound thereon to a larger amount for achieving a larger torque will render the space within the stator to be smaller and the contour to be still larger, and there has been a defect that the entire volume can not be made effectively smaller. That is, the more attempt is made to reduce the volume, the more space factor will be restricted to render the torque to be rather smaller so that there has been a defect that the general usage will become low. Further, while the output gear train can be contained in the interior space of the ring-shaped stator, the output shaft of the output gear train is usually positioned in the center of the ring, the degree of utilizing the interior space for other elements is low and the entire volume often has not been made small enough. In particular, as the end portions of the stator core are expanded to have a larger pole surface, the coil must be wound after the coil supporter is fitted onto the core, so that the coil winding must be made along the ring shape and the workability will be so low that there has been a problem in the mass-productivity. The present invention is suggested to solve the above described various problems.

Referring now to FIGS. 2 to 20, a motor-driven movement 10 according to the present invention comprises a stator block 11 and rotor 12 which are forming an electric motor, lower and upper circular casings 13 and 14 which can fit to each other so as to define between them a housing space, an output gear train 15 engaged with hour and minute hands and an electric circuit block 16 including respective circuit parts for the electric motor.

Figure 2:
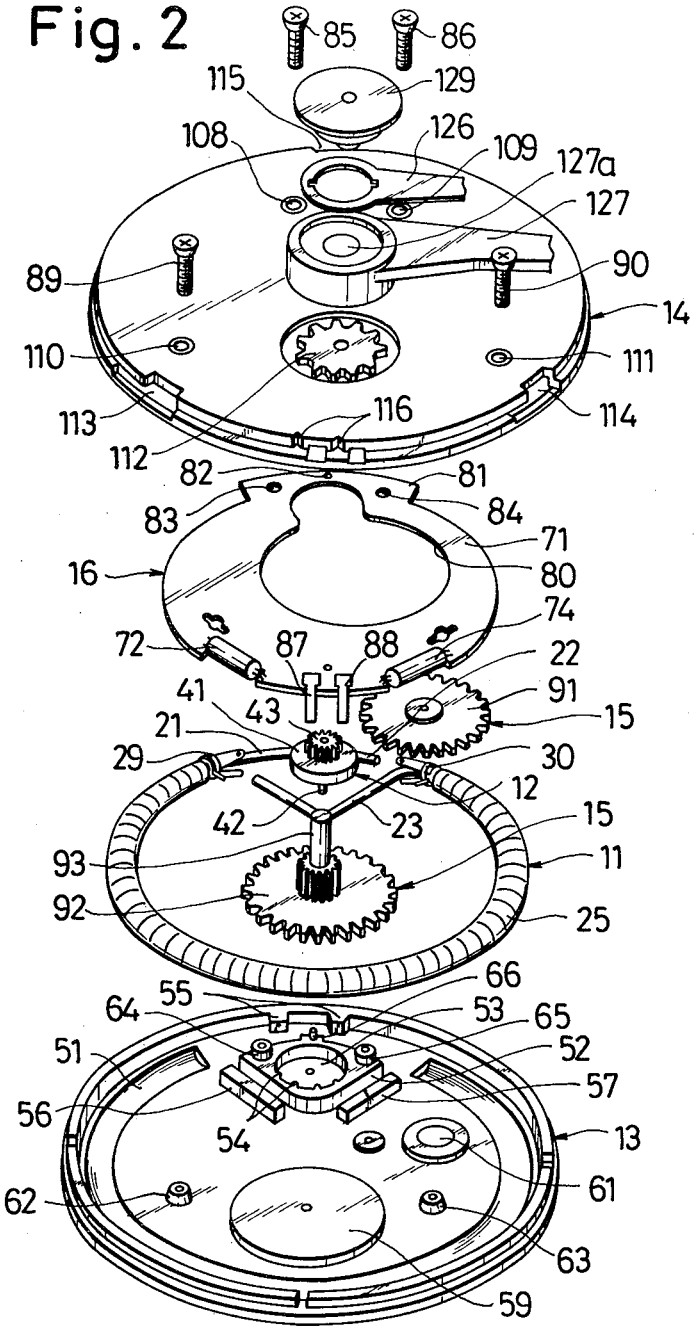
FIG. 2 is a perspective view as disassembled of a motor-driven movement for timepieces in an embodiment according to the present invention.

According to an aspect of the present invention, particularly with reference to FIG. 2, a round-sectioned and bar-shaped magnetic material of, for example, permalloy or electromagnetic soft iron is used for a core 21 of the stator block 11 to improve the space factor and to expand the housing space for respective required components. The core 21 is curved to be substantially ring-shaped in the contour, one end portion 22 forming one magnetic pole extends in the peripheral direction, while the other end portion 23 forming the other magnetic pole is bent to be substantially L-shaped as directed inward in the radial direction to have its bent portion of the L-shape directed toward the center of ring-shaped contour. Further, a coil 25 is wound on the core 21 through a hollow coil supporter 24 except for the end portions forming the magnetic poles.

Figure 4:
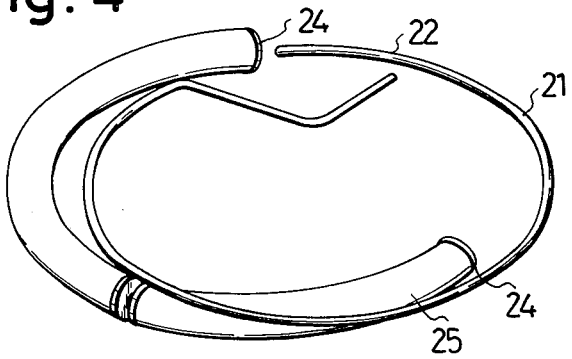
FIG. 4 is a perspective view as disassembled of a stator in the embodiment of FIG. 2.
Figure 5:
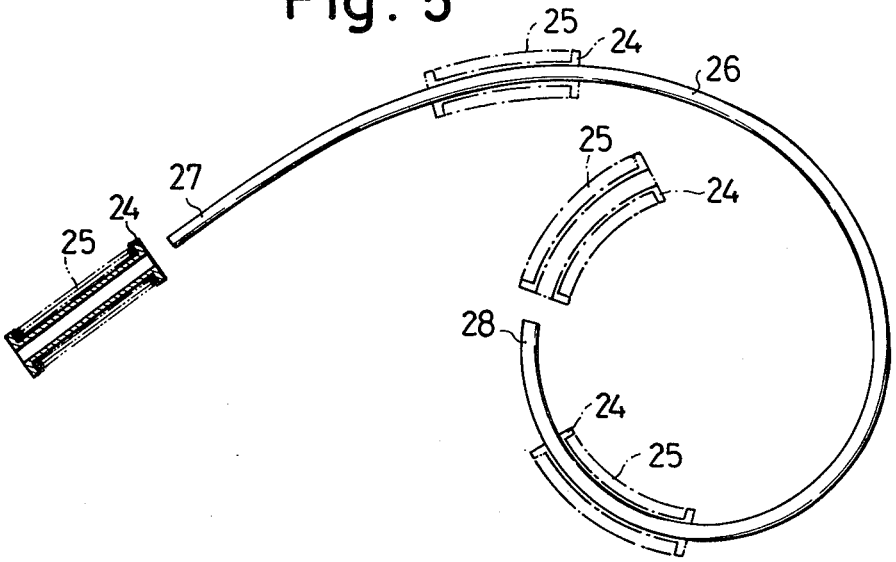
FIG. 5 is an explanatory view of the assembly of the stator in the embodiment of FIG. 2.

In manufacturing the coil 25, particularly with reference to FIG. 5, a spiral shaping pattern 26 preferably of a metal bar having substantially the same diameter as the core 21 is used. In this case, initially the coil 25 is wound on the coil supporter 24 which is straight but bendable, so as to be straight in the entirety, then a straight part 27 at one end of the shaping pattern 26 is inserted through the axial hollow part of the coil supporter 24, and the coil 25 with the supporter 24 is further gradually moved along the spiral line of the pattern 26. The other end 28 of the shaping pattern 26 is curved with substantially the same curvature as the ring-shaped core 21, and the coil 25 wound on the coil supporter 24 reaching this position to be thus curved into desired shape of the ring-shape is impregnated with an insulating varnish or the like which is thereafter solidified. Therefore, the coil supporter and coil will be shaped so that they can be smoothly mounted from the one end portion 22 extending in the peripheral direction of the core 21 toward the other end portion 23 bent to be L-shaped. Further, the coil supporter 24 employed in the present invention may be of a single member as shown in FIG. 2 or may be divided into a plurality of portions as shown in FIGS. 4 and 5.

Figure 6:
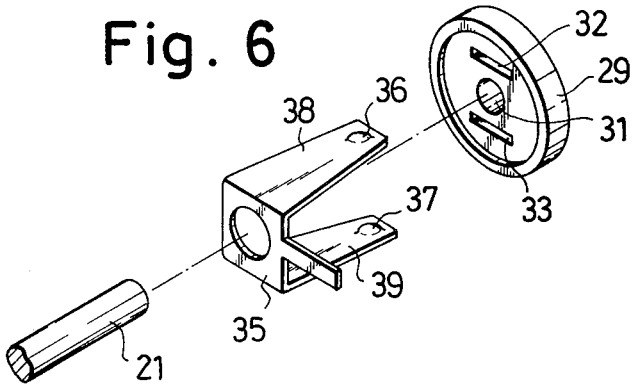
FIG. 6 is a perspective view as disassembled of an end holding member for a stator coil in the embodiment of FIG. 2.
Figure 7:
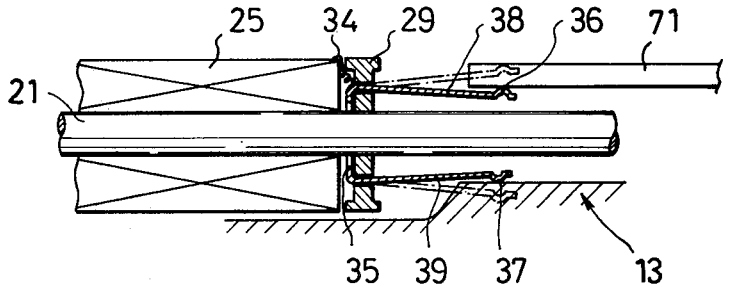
FIG. 7 is a fragmentary sectioned view as magnified at one end of the stator in the embodiment of FIG. 2.
Figure 9:
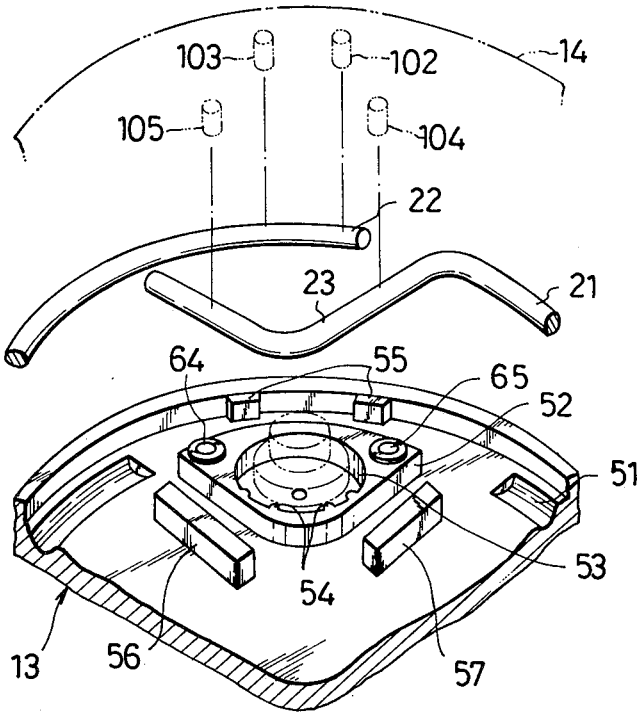
FIG. 9 is a fragmentary perspective view as disassembled showing a holding formation of stator end and rotor in the embodiment of FIG. 2.

Further, such disk-shaped coil-end plates 29 and 30 as shown in FIGS. 6 and 7 are fitted to the boundaries between the coil winding zone on the core 21 and the magnetic pole zones at the respective ends, and slits 32 and 33 extending in the horizontal direction symmetrically with respect to a core inserting hole 31 are made in the coil end plates 29 and 30. A lead 34 of the coil 25 is connected to a coil connecting terminal 35 through which the core 21 is passed. The coil connecting terminal 35 itself is formed to be U-shaped and has contact legs 38 and 39 which are respectively opened as directed outward to be separated from each other while being provided with contact points 36 and 37 and projected in the same extending direction as the core 21 through the slits 32 and 33 of the coil-end plates 29 and 30. In this case, as the contact legs 38 and 39 are opened outward to be thus inclined in the directions separating from each other, a favorable electric connection can be obtained as detailed later. While FIGS. 6 and 7 do not show the supporter 24, the coil-end plates 29 and 30 can be formed integral with the coil supporter 24, if so desired. The coil supporter 24 may be in such member as an insulative paper or the like.

The rotor 12 of the motor comprises an axial shaft 42 passing through a disk body 41 which is magnetized to have two opposite magnetic poles on both sides of the vertical plane including the axis of the shaft 42, and an output pinion 43 provided integrally at an end of the shaft 42.

According to another aspect of the present invention, arrangements of the magnetic poles of the stator block 11 as well as the rotor 12 are so made that they are favorably held in position at a high precision and a reliable stepwise operation of the motor can be assured. Particularly with reference to FIGS. 2, 8, 9 and 11, an annular recess 51 having a curved bottom surface is formed in the peripheral part of the lower casing 13 so as to extend in the peripheral direction of the casing substantially for the same length as the coil winding zone of the stator block 11. Further, a sector-shaped base 52 is provided in the lower casing 13 so as to integrally extend therein at a position between both ends of the annular recess 51, so that the apex of the sector-shape is directed toward the center of the lower casing 13 and the arcuate part is positioned to contact the inner side in the radial direction of the core 21 lying in the peripheral direction, and a circular recess 53 of a diameter larger than the outermost diameter of the rotor 12 is provided substantially in the center of the base 52. Inward projecting ribs 54 are provided on the peripheral wall of the recess 53 specifically on the apex side of the base 52, for preventing any excess inclination of the rotor 12 as disposed in the circular recess 53. In other words, even when the circular rccess 53 is formed to be of a diameter well larger than the outermost diameter of the rotor 12, the rotor 12 will be prevented by the projecting ribs 54 from inclining excessively. On the other hand, pressing projections 55 are provided to project inward in the radial direction on the inside surface of the outermost peripheral part of the lower casing 13. The one end portion 22 extending in the peripheral direction and forming one magnetic pole of the core 21 is positioned between the arcuate part of the sector base 52 and the pressing projections 55. Further, near the respective radial sides of the sector base 52 of the lower casing 13, pressing projections 56 and 57 are provided to project as separated from the base 52 by a distance substantially corresponding to the diameter of the core 21, so that the other L-shaped end portion 23 forming the other magnetic pole of the core 21 will be positioned between the base 52 and the respective projections 56 and 57.

Figure 8:
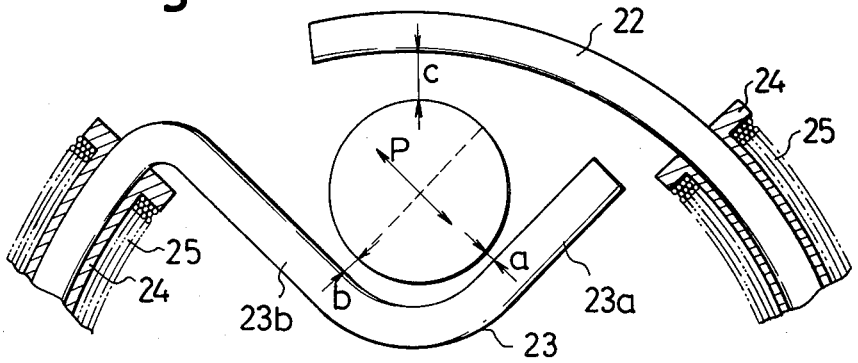
FIG. 8 is a fragmentary plan view showing positional relation of the stator and rotor in the embodiment of FIG. 2.

In the present instance, the dimensions and positions of the sector base 52 in its outline, circular recess 53, projecting ribs 54 and pressing projections 55, 56 and 57 are so made that, when the respective end portions 22 and 23 of the core 21 and rotor 12 are arranged in the predetermined positions, particularly as shown in FIG. 8, the distance "a" between outer tip end leg part **23*a* of the L-shaped end portion 23 of the core 21 and the rotor body 41, the distance "b" between inner continuing leg part 23*b* also of the L-shaped end portion 23 of the core 21 and the rotor body 41 and the distance "c" between the one end portion 22 of the core 21 and the rotor body 41** will be in such relation that $a<b<c$.

Figure 3:
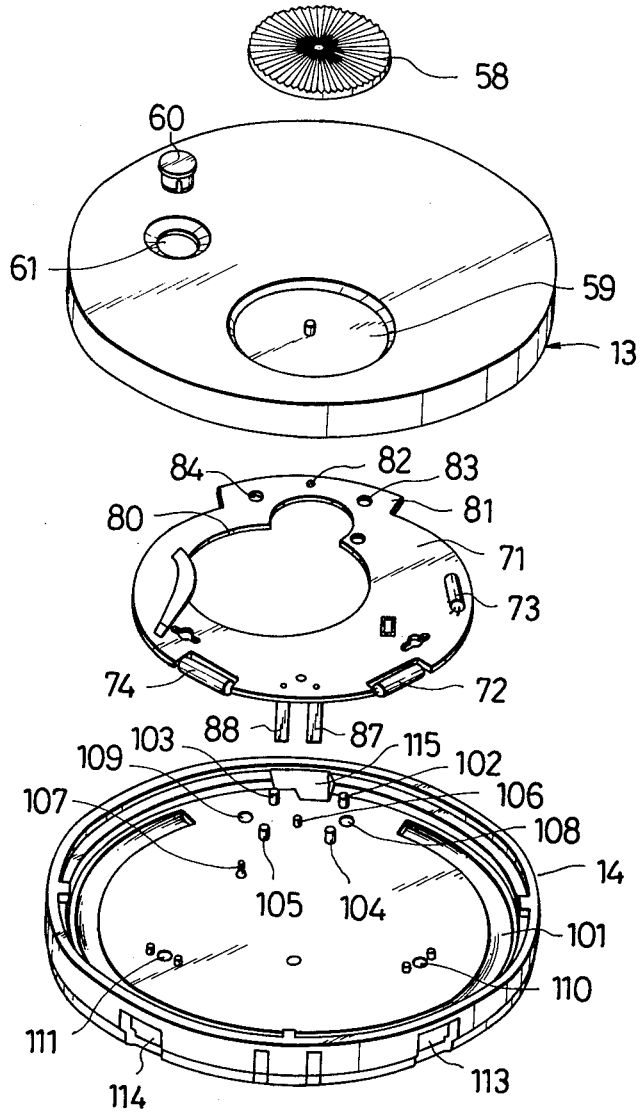
FIG. 3 is a perspective view as disassembled of the movement shown in FIG. 2 as seen from the other bottom side.

In the lower casing 13, as will be clear specifically in view of FIG. 3, a recessed part 59 for receiving a manually rotating wheel 58 and another recessed part 61 for receiving a resetting button 60 are formed on the exterior side of the lower casing 13. Further in the lower casing 13, as described later, projections 62 and 63 having screw holes contributing to the fitting of the casing 13 to the upper casing 14 are provided, and projections 64 and 65 having screw holes contributing to a fixation of the circuit block 16 and a pin 66 are provided to project on the upper surface of the base 52. A shaft bearing hole and output gear bearing part are formed respectively in the center of the circular recess 53 and recessed part 59.

Figure 13:
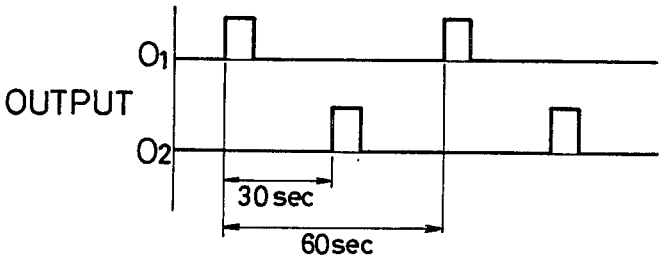
FIG. 13 is an explanatory view for the operation of the driving circuit shown in FIG. 12.

The circuit block 16 is provided to be mountable in the lower casing 13 and on the stator block 11. The block 16 comprises a printed base plate 71 having respective such required circuit parts for controlling the motor as being known per se. Further, with reference to FIG. 12, in the controlling circuit, an inverter 75 and resistance 76 are connected in parallel to a series circuit of a capacitor 72, quartz vibrator 73 and trimmer capacitor 74, and a frequency dividing circuit 77, wave-form shaping circuit 78 and driving circuit 79 are connected sequentially to the output end of the inverter 75. In this case, the circuit from the inverter 75 to the driving circuit can be also made in one chip to be an integrated circuit. The output terminals **79*a* and 79*b* of the driving circuit 79 are connected to both ends of the coil 25 of the stator block 11. On the other hand, the current source voltage of the circuit block 16 is obtained from a secondary battery charged by a later described solar battery. Such output wave-form as shown in FIG. 13 is given, in particular, by the action of the quartz vibrator 73, whereby the rotor 12 is caused to perform its ½ rotation per 30 seconds through the two magnetic poles of the stator block 11**.

Referring in particular to FIGS. 2 and 3, the printed base plate 71 is formed to be of a dimension in its contour smaller than the inside diameter of the coil 25, and a large opening 80 substantially key-hole-shaped is made so that the output gear 15 can rotate without contacting the printed base plate 71. Further, the printed base plate 71 is provided with a resetting terminal (not shown) with which the resetting button 60 fitted to the lower casing 13 is engageable when the button is depressed so that a current will flow in the circuit for resetting the count of seconds. A fixing part 81 is expanded as directed outward in the radial direction at a part of the periphery of the printed base plate 71. A hole 82 is provided substantially in the center of the fixing part 81 for allowing a pin 66 on the base 52 of the lower casing 13 to be engaged therein. Further fitting holes 83 and 84 provided as separated from each other in the peripheral direction with respect to the hole 82 are aligned respectively with the projections 64 and 65 on the base 52 and, therefore, the printed base plate 71 can be fixed onto the base 52 of the lower casing 13 at the fixing part 81 by means of screws 85 and 86.

When the fixing part 81 of the printed base plate 71 is thus fixed to the lower casing 13, particularly as shown in FIG. 7, the contact leg 39 is urged into contact with the inner surface of the lower casing 13 while being displaced inward so that the other contact leg 38 will be urged into contact with the printed base plate 71 under a sufficient contact pressure to be directly positively connected with the coil 25 and conducting part of the printed base plate 71 or, preferably, with output terminals **79*a* and 79*b* of the driving circuit 79. Further, as described later, pull-out terminals 87 and 88 provided to the printed base plate 71** are connected to the secondary battery provided in an associated clock body.

According to still another aspect of the present invention, a minute hand wheel 92 of the output gear train is displaced from the center of the lower casing in order to achieve a compact arrangement. More particularly, a center wheel 91 and minute hand wheel 92 are included in the output gear train 15 meshing with the output pinion 43 of the rotor 12 and the minute hand wheel 92 is so provided as to be operatively connected with the manually rotating wheel 58 of the lower casing 13 displaced to the side radially opposed to the base 52 from the center of the lower casing 13, as seen specifically in FIG. 20.

Figure 10:
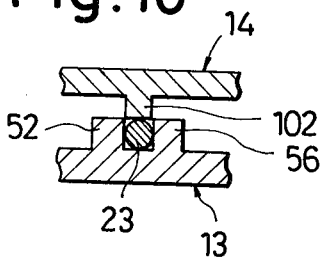
FIG. 10 is a fragmentary sectioned view showing the stator end holding formation in the embodiment of FIG. 2.
Figure 11:
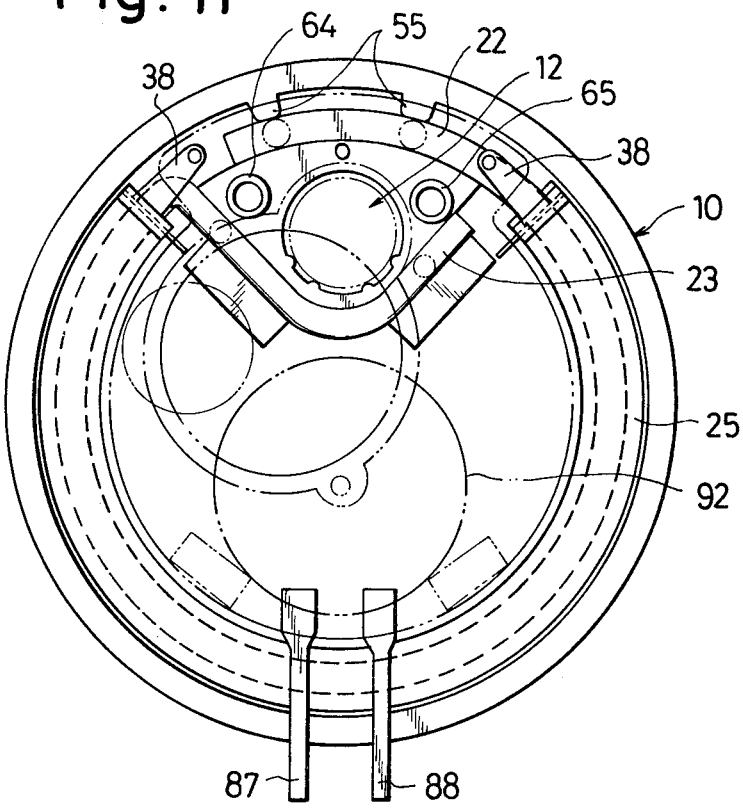
FIG. 11 is a plan view as assembled of the movement in the embodiment of FIG. 2 with a cover removed.
Figure 18:
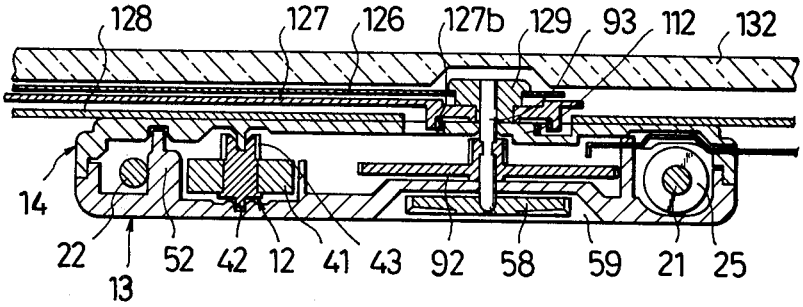
FIG. 18 is a sectioned view of the movement according to the present invention shown as incorporated into the clock shown in FIGS. 16 and 17 but shown here fragmentarily.
Figure 12:
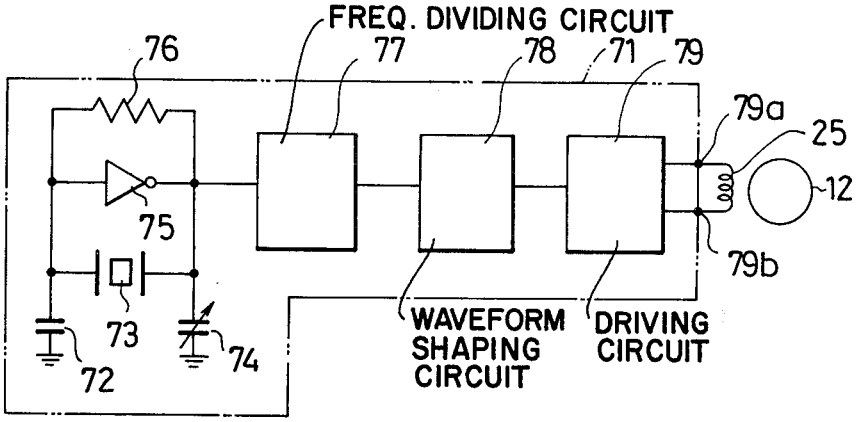
FIG. 12 is a diagram showing a driving circuit for the motor in the embodiment of FIG. 2.

As seen in FIG. 3, an annular recess 101 having a curved bottom surface extending in the peripheral direction substantially by the same length as the coil winding zone of the stator block 11 is formed also in the upper casing 14, so that the both recesses 51 and 101 of the both casing 13 and 14 will oppose each other when the casings are fitted together, for enclosing the stator block 11 in these recesses. Four pressing projections 102 to 105 are provided on the inner surface of the upper casing 14 so as to press, from above as seen in FIG. 10, the respective end portions of the core 21 into their engagement in respective clearances between the arcuate part of the sector base 52 of the lower casing 13 and the pressing projections 55 and between the respective radial sides of the base 52 and the pressing projections 56 and 57, and pins 106 and 107 to be engaged respectively in an axial hole of the rotor 12 and center wheel 92 of the output gear train 15 are also provided to project in the casing 14. Further, screw inserting holes 108 to 111 aligned respectively with the projections 62 and 63 of the lower casing 13 and with the holes 83 and 84 of the printed base plate 71 are provided in the upper casing 14. Thus, the upper and lower casings 13 and 14 and printed base plate 71 can be easily and reliably fixed by means of screws 89 and 90 in addition to the foregoing screws 85 and 86. Further, a fixed gear 112 having 11 teeth is provided on the upper casing 14 at the position of inserting the axial shaft 93 of the minute hand wheel 92 in the upper casing 14, that is, at the position substantially symmetrical with the pin 106 engaging with the rotor 13 with respect to the center of the upper casing 14. In the present instance, as will be clear in FIGS. 2 and 19, the fixed gear 112 is formed within a recess as retreated from the outer surface of the upper casing 14, so as to reduce the thickness of the entire movement 10. Further, three apertures 113 to 115 for clamping the movement 10 to a later described clock body are provided on the periphery of the upper casing 14, and these apertures are varied in the shape to have wide and narrow portions.

Figure 15:
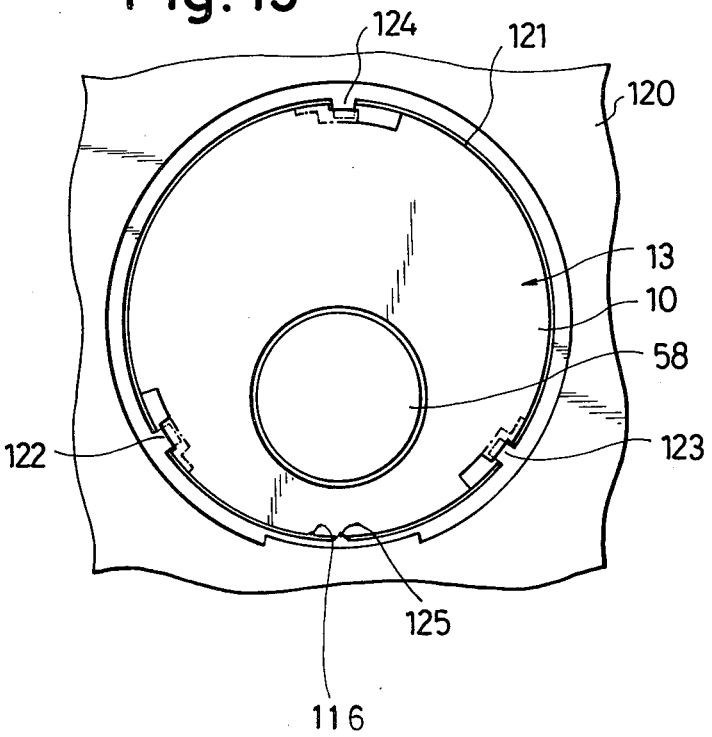
FIG. 15 is a bottom plan view of the movement in the embodiment of FIG. 2 as incorporated in the clock body shown fragmentarily.
Figure 14:
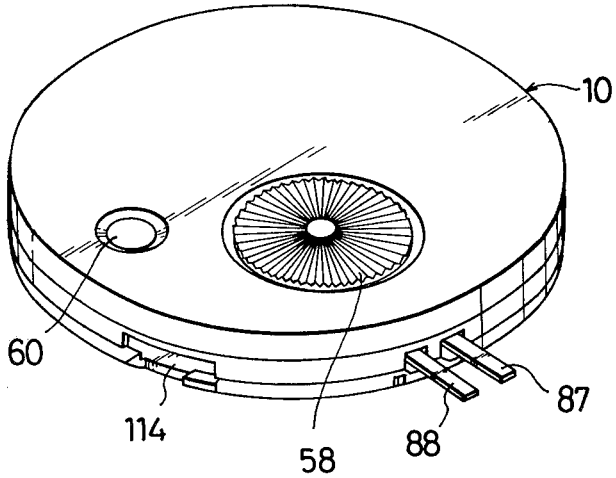
FIG. 14 is a perspective view as assembled of the movement shown in FIG. 2 with a fragmentary portion of a clock body to which the movement is incorporated.
Figure 14:
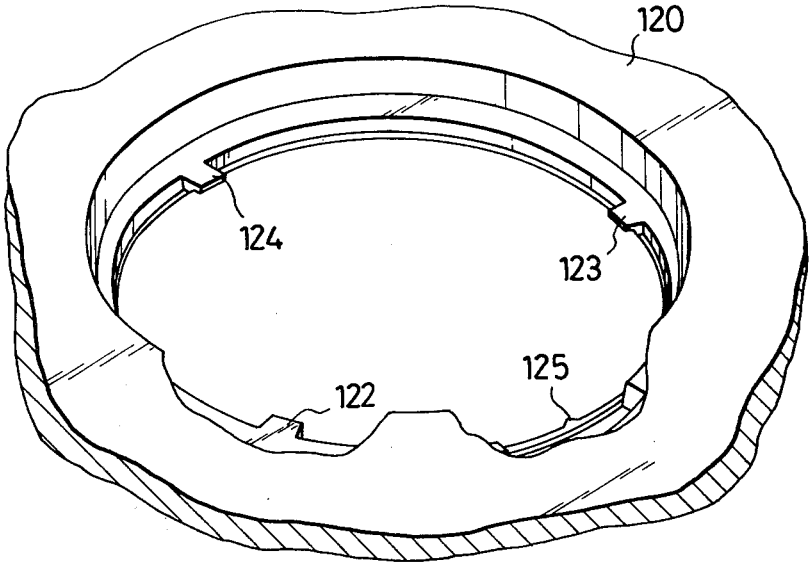

On the other hand, by references to FIGS. 14 and 15, an associated clock body 120 has a circular recess 121 substantially of the same diameter as the outer diameter of the movement 10, for incorporating the movement 10 to the clock body 120. Engaging projections 122 to 124 projecting inward in the radial directions are provided on the peripheral wall of the circular recess 121 and, when the engaging projections 122 to 124 are fitted respectively into the apertures 113 to 115 and the movement 10 is rotated, the engaging projections 122 to 124 will engage respectively into the narrow portion from the wide portion of the respective apertures 113 to 115 and the movement 10 can be clampingly mounted to the clock body 120. In this case, it is preferable that a recess 116 is formed in the periphery of the upper casing 14 and a projection 125 engageable into the recess 116 is provided in the circular recess 121 of the clock body 120 so as to stop a rotation of the movement 10 in the recess 121.

Figure 16:
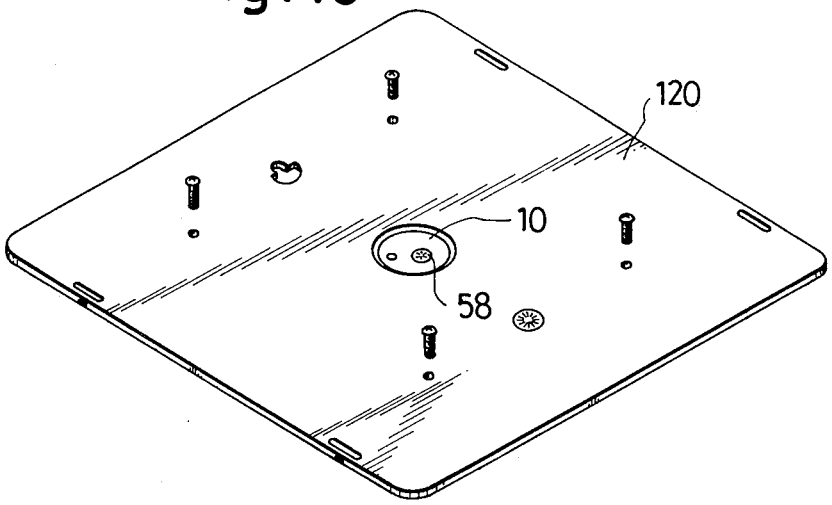
FIG. 16 is a perspective view as disassembled and as seen from the bottom side of an exemplary wall-hung clock to which the movement according to the present invention is applied.
Figure 16:
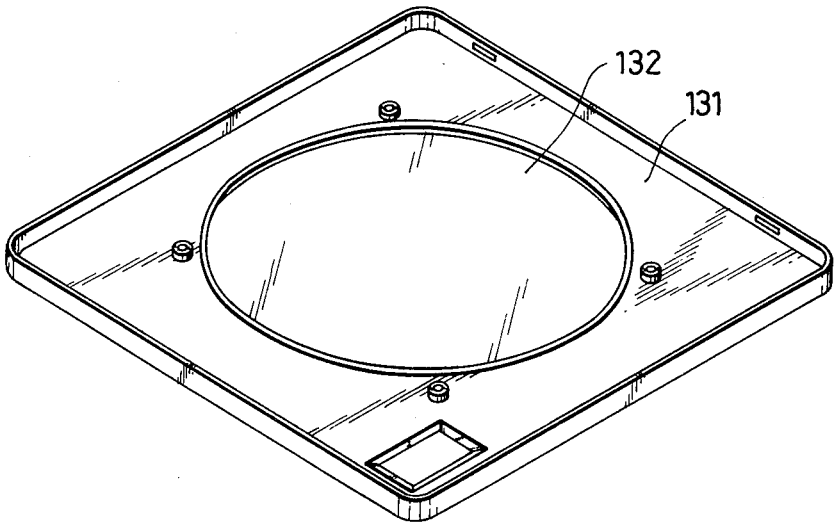
Figure 17:
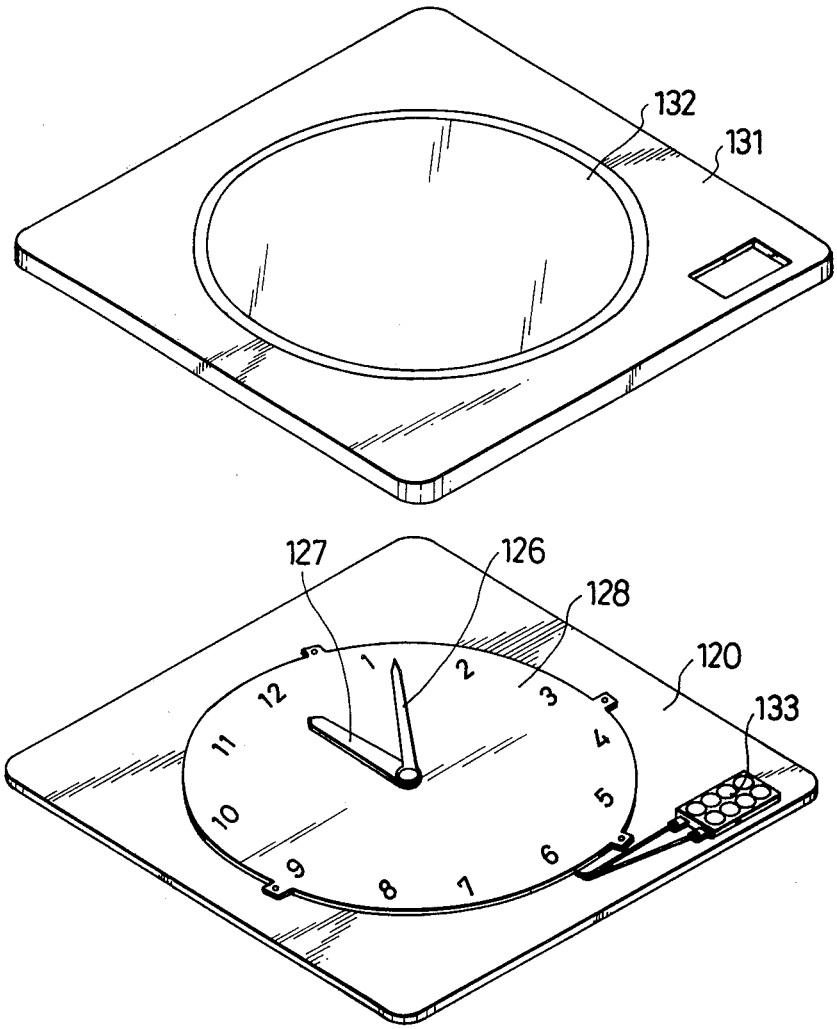
FIG. 17 is a perspective view as disassembled of the wall-hung clock shown in FIG. 16 as seen from the front side.
Figure 19:
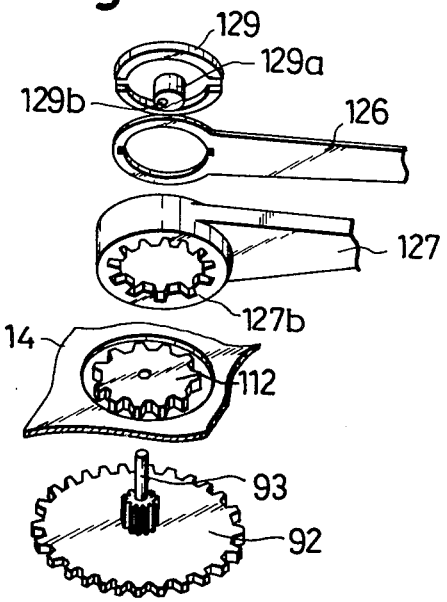
FIG. 19 is a perspective view as disassembled of a gear train with hour and minute hands shown fragmentarily to be engaged with the output gear train in the movement according to the present invention.
Figure 20:
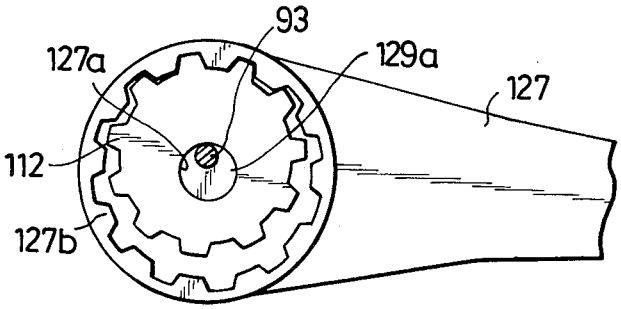
FIG. 20 is a bottom plan view as assembled of respective members shown in FIG. 19.

Referring next to FIGS. 16 and 17, the clock body 120 comprises a cover body 131 having a transparent round covering 132 which is fitted to the body 120 by means of screws, and a dial in the center of which, for example, such two hands as a minute hand 126 and hour hand 127 rotate. Particularly with reference to FIGS. 18, 19 and 20, the minute hand 126 is fitted to the shaft 93 of the minute hand wheel 92 through a minute hand bush 129 having an eccentric cam **129*a* and tightly receiving the shaft 93. The eccentric cam 129*a* itself is fitted in a center hole 127*a* in the base part of the hour hand 127. An internal gear 127*b* is formed on the bottom surface of the base part of the hour hand 127 is provided with 12 teeth. When a driving force is transmitted through the eccentric cam 129*a* from the minute hand wheel 92, the internal gear 127*b* will mesh with the fixed gear 112 formed as retreated from the outer surface of the upper casing 14 while being eccentric with respect to the minute hand wheel shaft 93. The gear ratio is set to be 11:12 and, when the minute hand wheel 92 rotates by 360 degrees, the hour hand will rotate by 1/12 rotation, that is, by 30 degrees. Further, the clock body 120 is provided preferably with a solar battery 133 so that a current source voltage will be given from the solar battery 133 to the circuit block 16 through a secondary battery (not shown) provided preferably in the clock body 120**.

Further, the operation of the present invention shall be described. Now, in the particular embodiment shown, a voltage is applied to the circuit block 16 from the secondary battery charged with the voltage from the solar battery 133, and an electric current of such wave-form as in FIG. 13 will be made to flow through the coil 25 of the stator block 10 from the controlling circuit of the circuit block 16 at intervals of 30 seconds. (It will be easily understood that, though two hands are used in this embodiment, it should be apparent to the one skilled in the art that three hands can be employed and, in such case, the wave-form of FIG. 13 will be generated every second and a desired reduction gear train is to be added.) Therefore, the respective end portions 22 and 23 of the core 21 will be magnetized alternately and, as the distances "a", "b" and "c" between the rotor 13 and the respective front and rear sides **23*a* and 23*b* of the other end portion 23 and the one end portion 22 of the core 21 are $a>b>c$, the rotor 13 will operate at a half rotation step at intervals of 30 seconds in the magnetically balanced direction, that is, clockwise in, for example, FIGS. 2 and 10**.

With the rotation of the rotor 13, the torque will be transmitted to the center wheel 91 and minute hand wheel 92 and, if the reduction ratio of the speed of the minute hand wheel 92 to the speed of the output pinion 43 of the rotor 13 through the center wheel 91 is made 1/60, the minute hand wheel 92 will make 1/120 rotation. As the shaft 93 of the minute hand wheel 92 projects upward from the center of the fixed gear 112 displaced from the center of the upper casing 14 but the movement 10 is attached to the clock body 120 so as to have the shaft 93 aligned with the center of the dial 128, the time indicating operation will not be obstructed. Minutes will be thus indicated by the minute hand 126 coupled to the shaft 93.

Further, the internal gear **127*b* at the base part of the hour hand 127 is rotated through the eccentric cam 129*a* of the minute hand bush 129 fixed to the shaft 93 and made integral with the minute hand 126 and, as this internal gear 127*b* meshes with the fixed gear 112 of the upper casing 14, the hour hand 127 achieves 1/12 rotation for every rotation of the minute hand wheel 92 and hours will be indicated by the hour hand 127**.

On the other hand, the time can be properly adjusted by forcibly rotating from outside the lower casing 13 the manually rotating wheel 58 operating integrally with the minute hand wheel 126. At this time, the rotor 12 is also moved jointly but, when a force larger than the electric rotary torque is applied, the rotor 12 can freely rotate within the circular recess 53 of the sector base 52 and, therefore, the output gear train 15 and others will not be overloaded.

According to the present invention having such arrangements as described above, particularly, as the magnetic poles formed of the respective end portions of the core 21 of the stator block 11 are arranged as opposed to each other in the radial direction of the ring-shaped core 21 and the minute hand wheel 92 driven by the center wheel 91 operatively connected with the rotor 12 is arranged as displaced from the center of the stator block 11, even if the diameter of the coil 25 of the stator block 11 is relatively small, the internal components of the movement 10 can be housed efficiently the internal space of the coil 25 and well within the outline of the coil 25, utilizing the space enlarged by the off-centered minute hand wheel 92. Therefore, the internal components of the movement 10 can be compactly arranged to be thin and small, so that the upper and lower casings 13 and 14 can be made substantially only slightly larger than the stator block 11, and the total volume of the movement 10 can be remarkably minimized. Further, in the present instance, the hour hand can be actuated by the meshing of the fixed gear with the eccentrically rotating internal gear and at least one transmitting gear can be omitted as compared with conventional movements. In addition, as the fixed gear is positioned as retreated from the outer surface of the upper casing, the volume can be greatly made smaller in this respect, too.

Further, as a round-sectioned bar is adopted for the core 21 of the stator block, the space factor can be greatly improved and, with the same driving torque to be obtained, the diameter of the stator block can be made smaller and the entire volume can be also made smaller.

Further, by adopting the round-sectioned bar material for the core 21, the coil 25 as wound on the supporter 24 in advance can be fitted to the core 21 and, as compared with a flat core which has magnetic poles formed by expanding the end portions and on which a coil must be annularly wound, the manufacturing work can be greatly simplified.

As the volume can be made smaller, the general usage of the movement in various sized clocks is high and yet the movements can be mass-produced very economically.

What we claim as our invention is:

1. A motor-driven movement for time-pieces comprising a stator block in which a coil is wound on a core of a ring shape and formed of a round-sectioned and bar-shaped magnetic material and magnetic poles formed of respective end portions of said core are opposed in the radial direction of said ring shape of the core, one of said end portions of said core being positioned in the peripheral direction and the other end portion being bent to an L-shape, a rotor arranged between respective said magnetic poles, an output gear train including a minute hand wheel disposed as displaced in the radial direction from the center of the ring shape, and a circuit block for controlling power supply to said coil to operate said output gear train stepwise, said stator block, rotor, output gear train and circuit block being arranged within a pair of mutually fitting lower and upper casings slightly larger than said stator block, a sector base having an arcuate part disposed along one end portion of said core and two radial sides disposed along the other end portion is provided in one of said casings and a circular recess for receiving said rotor is formed in said sector base.

2. A movement according to claim 1 wherein one of said casings is provided, on the inner surface of a peripheral part, with first pressing projections for positioning said one end portion of said core adjacent the arcuate part of said sector base as directed inward in the radial direction of said ring shape and, adjacent the respective radial sides of the sector base, with second pressing projections for positioning said the other end portion of the core along said radial sides of the sector base.

3. A movement according to claim 1 wherein said circular recess is provided with ribs projecting in the radially inward direction from the peripheral wall of the recess.

4. A movement according to claim 1 wherein the other one of said casings is provided on the outer surface thereof with a fixed gear as displaced in the radial direction from the center of said casing, said fixed gear allowing the axial shaft of a minute hand wheel to pass through the center of the gear and having 11 teeth on the periphery, a minute hand having an integral eccentric cam is mounted to said shaft projecting out of said fixed gear, and an hour hand provided with an internal gear having 12 teeth capable of meshing with the fixed gear is connected to said eccentric cam so as to perform a 1/12 rotation.

* * * * *